US006719653B1

(12) United States Patent
Nesbitt

(10) Patent No.: US 6,719,653 B1
(45) Date of Patent: Apr. 13, 2004

(54) HOLLOW CENTER THERMOSET ELASTOMERIC GAME BALL

(75) Inventor: R. Dennis Nesbitt, Westfield, MA (US)

(73) Assignee: Russell Asset Management, Inc., Bloomington, DE (US)

( * ) Notice: Subject to any disclaimer, the term of this patent is extended or adjusted under 35 U.S.C. 154(b) by 380 days.

(21) Appl. No.: 09/675,739

(22) Filed: Sep. 28, 2000

(51) Int. Cl.[7] ..... A63B 39/00
(52) U.S. Cl. ..... 473/600
(58) Field of Search ..... 473/600, 601, 473/602, 598

(56) References Cited

U.S. PATENT DOCUMENTS

| | | | | | |
|---|---|---|---|---|---|
| 712,412 | A | | 10/1902 | Richards | |
| 1,320,221 | A | | 10/1919 | Fukuda | |
| 2,989,782 | A | * | 6/1961 | Barkhuff, Jr. et al. | 473/600 |
| 3,908,993 | A | | 9/1975 | Gentiluomo | |
| 4,144,297 | A | * | 3/1979 | Tomar | 473/600 |
| 4,211,407 | A | * | 7/1980 | Tomar | 473/600 |
| 4,364,565 | A | | 12/1982 | Tomar | |
| 4,498,667 | A | * | 2/1985 | Tomar | 473/600 |
| 4,529,200 | A | * | 7/1985 | Miller et al. | 473/601 |
| 4,568,083 | A | | 2/1986 | Miller | |
| 4,572,507 | A | * | 2/1986 | Hubbert et al. | 473/601 |
| 4,610,071 | A | | 9/1986 | Miller | |
| 4,653,752 | A | * | 3/1987 | Miller | 473/601 |
| 4,660,830 | A | * | 4/1987 | Tomar | 473/601 |
| 4,840,378 | A | * | 6/1989 | Molitor | 473/600 |
| 4,861,028 | A | | 8/1989 | Williams | |
| 4,880,233 | A | | 11/1989 | Song | |
| 5,035,425 | A | | 7/1991 | Edwards | |
| 5,062,912 | A | | 11/1991 | Hoffman | |
| 5,123,659 | A | * | 6/1992 | Williams | 473/601 |
| 5,665,188 | A | * | 9/1997 | McClure et al. | 156/93 |
| 5,704,858 | A | * | 1/1998 | Yang | 473/602 |

OTHER PUBLICATIONS

Official Rules of Softball, International Softball Federation, 1999.*

Internet Article: LIFT By: Paul Terrenzio and Ryan White; "Outline of Lift Project", Dated Jul. 21, 1998 (p. 1).

Internet Article: Title: The Aerodynamics of the Knuckleball; 2 Pages; Dated: Aug. 13, 1998; Copyright 1997 by Cislunar Aerospace, Incorporated.

Internet Article: Why are Golf Balls Dimpled? (2 Pages) Dated: Jul. 21, 1998.

Internet Article: The Curveball (p. 1); Wrap–Up; Dated: Jul. 21, 1998 (p. 2).

Internet Article: The Magnus Effect; (pp. 1–3); Dated: Jul. 21, 1998.

Internet Article: The Magnus Effect; Or "Why Do Cricket Balls Swing and Curve Balls Curve?" (pp. 1–6) Dated: Jul. 21, 1998.

Internet Article: Moments of Inertia–Demonstration Goals; Dated: Jul. 21, 1998.

Internet Article: Mass Moment of Inertia; (p. 1–3); Dated Jul. 21, 1998.

Internet Article: Jul. 20, 1998, 15:11, p. 1–6.

* cited by examiner

*Primary Examiner*—Steven Wong
(74) *Attorney, Agent, or Firm*—Thomas, Kayden, Horstemeyer & Risley, LLP

(57) ABSTRACT

A game ball having a hollow core structure which is resistant to permanent denting or "oil canning" when struck with a bat. The game ball also has a higher moment of inertia due to its hollow construction and consequently has a lower spin rate making it more suitable for play in confined areas and for use by lower skilled players. The core of the ball is formed from a thermoset elastomeric material and the wall thickness of the game ball ranges from 10 to 36 mm.

15 Claims, 2 Drawing Sheets

HOLLOW CENTER THERMOSET ELASTOMERIC GAME BALL

FIELD OF THE INVENTION

The present invention relates generally to game balls and more particularly is directed to game balls having a hollow central core for use in playing baseball and softball.

BACKGROUND OF THE INVENTION

Professional and competitive play game balls such as baseballs and softballs are traditionally constructed with a solid, spherical central core formed of cork, kapok, or other similar material, surrounded by windings of thread or yarn, and covered with a stitched-on leather cover. These traditionally constructed game balls typically possess excellent play characteristics, particularly when they are new. However, they are also relatively expensive and thus are rarely used outside high levels of game play.

In spite of the expense and the care that goes into manufacturing, balls having a traditional construction often have a very limited playing life. Striking a ball with a bat in the normal course of play often causes the surface of the ball to become flattened at the point of impact, or to otherwise depart from its original spherical shape. Forces from the impact between the ball and bat also travel through the ball and contribute to the breakdown and destruction of the central core. A ball with traditional construction that receives repeated bat impacts may loose much of its liveliness as the central core deteriorates. Therefore, baseballs of traditional construction are often removed from play in professional and high level competitive play after relatively little use.

An additional problem associated with balls having a central core of cork or kapok resides in variation of the core density. As cork and kapok are naturally occurring materials, little can be done to control their density. It will be appreciated that core densities which are significantly out of average will contribute to a ball falling outside of acceptable weight range limits and may cause the ball to have non-standard performance. Therefore, central cores made of cork and kapok are subject to rejection due to wide variations in density. Naturally, this contributes to increasing the expense of the finished game ball.

A further problem associated with a baseball or softball of traditional construction resides in the physical distribution of the ball's mass within the structure of the ball. The traditional solid central core centralizes the mass of the ball, resulting in a lower moment of inertia when compared to a ball having its mass distributed nearer its exterior surface. A lower moment of inertia manifests itself in certain aspects of ball performance such as a higher spin rate and an increased influence from Magnus effect. The net effect of higher spin rates and increased Magnus effect makes such a ball tend to fly higher and/or curve more strongly in flight. For play in confined areas or for use as a "training ball" by less skilled players, a ball with a higher moment of inertia and consequently, lower spin rate and less Magnus effect influence is preferred.

It is therefore a goal of sporting goods manufacturers to develop game balls, such as baseballs and softballs, which have the look, feel and handling characteristics of traditional game balls but which are economical for the consumer to use and are highly durable. In addition, it is a goal of sporting goods manufacturers to develop such game balls which have play characteristics including lower spin rate and lower influence from Magnus effect. To this end a number of balls have been developed wherein the traditional central core materials of cork and kapok are replaced with various non-traditional materials, the central core has new configurations or in some balls, the windings are eliminated.

U.S. Pat. No. 5,035,425 discloses a non-regulation light weight play ball comprising a spherical shell of high density elastomeric polyurethane material wherein the shell has a wall thickness believed to be sufficient to return the shell to its original shape following deformation from bat impact. The central core may be hollow or optionally filled with a low-density foam. Preferably, the shell has a thickness in the range of 1/16 to 1/4 inch (approximately 1.60–6.41 mm).

U.S. Pat. No. 4,610,071 relates to a method of making a game ball, such as a baseball or softball. The method includes forming two hemispherical shells of a polyolefin material, placing within the hemispherical shells chemicals which, when they react, expand to form a plastic foam material. The two hemispherical shells are welded together and the foaming materials react to fill the hollow central core within the welded hemispheres with a plastic foam. A cover may then be sewn in place over the core structure.

U.S. Pat. No. 4,880,233 discloses a game ball that is both lighter and softer than regulation game balls. The game ball of the '233 patent is comprised of a resilient, central core tightly enclosed within a durable cover. The core is formed from two hemispherical shells molded from a rubber-based compound. The hemispherical shells define a hollow central core that may optionally be pressurized relative to the ambient atmospheric pressure in order to impart specific desired rebound characteristics to the game ball. The composition of the core includes 30–40 wt. % of a styrene butadiene rubber, 16–20 wt. % natural rubber, 33–37 wt. % calcium carbonate, and 5–9 wt. % silica powder.

U.S. Pat. No. 4,861,028 discloses a softball comprising a hollow spherical central core and a leather cover which surrounds the core. The spherical core is molded from a mixture of low-density polyethylene and ethylene acid copolymer resin. The '028 patent discloses that a desired coefficient of restitution of about 0.47–0.52 for the ball may be obtained when the core comprises 40–90 weight percent low density polyethylene and 10–60 weight percent of ethylene acid copolymer. The spherical core disclosed is preferably manufactured using conventional rotational molding techniques.

While the hollow balls previously known in the art may have a higher moment of inertia than do baseballs and softballs of traditional construction, they often tend to "oil can" or become permanently dented upon making solid striking contact with a baseball bat. Balls having a foamed core, as in U.S. Pat. Nos. 4,610,071 and 5,035,425, tend to resist permanent dents better than hollow core balls due to the structural support provided by the foam. However, a foamed core typically tends to concentrate mass toward the ball's center, lower moment of inertia and thus increase the rate of spin and Magnus effect influence, both of which are preferably avoided in a ball intended for play in a confined area or for a ball to be used by less skilled players.

SUMMARY OF THE INVENTION

An object of the invention is to provide a game ball with a center core having a hollow cavity which is resistant to permanent deformation or damage from making striking contact with a bat.

Another object of the present invention is to provide a game ball having the look and feel of a softball of traditional construction, but which has a hollow central core.

A further object of the present invention is to provide a game ball, such as a softball, which is less costly to manufacture than a game ball made using traditional construction techniques, yet retains the look and feel of a traditional softball.

A still further object of the present invention is to provide a game ball having a higher moment of inertia compared to a softball of traditional construction.

Other objects will be in part obvious and in part pointed out more in detail hereinafter. These and related objects are achieved by providing a game ball with a core defining a hollow central cavity. The core is preferably spherical in shape. The core is formed of a thermoset elastomeric material which, after molding and curing, may be characterized as a hard, rubber-like substance. The combination of the hard elastomeric material, selected for its physical properties, and the thickness of the core walls provide a ball which is less likely to "oil can" or otherwise be dented on making striking contact with a bat in the normal course of play. The use of a thermoset elastomeric material for the core also reduces the manufacturing cost of the ball compared to traditionally constructed game balls. Also, the thermoset elastomeric core material makes control of core density and overall ball weight much easier than in a ball with a natural material core. In addition, the hollow central cavity of the core raises the game ball moment of inertia compared to a solid center game ball, thereby providing desired performance properties.

A cover overlies the core. The cover may be comprised of natural leather, synthetic leather or other material sewn tightly around the core. Alternately, the cover may be molded on or may be a coating or polymeric skin formed over the core. The outer surface of the core may also form the cover of the ball.

In another embodiment, the inventive game ball may feature a core formed of multiple layers of material. In such a ball the outermost layer is preferably softer than the inner layer or layers of the core. The central cavity of the ball is hollow.

In yet another embodiment of the invention, the central cavity of the ball remains hollow, however the material from which the core is formed is at least partially cellular. The result is a core of thermoset elastomeric material wherein the density of the material and/or softness of the core or a portion of the core may be adjusted by adjusting the degree of "blowing". The cellular materials are of particular utility in combination with a multiple layered core embodiment of the invention.

A better understanding of the invention will be obtained from the following detailed disclosure of the article and the desired features, properties, characteristics, and the relation of the elements as well as the process steps, one with respect to each of the others, as set forth and exemplified in the description and illustrative embodiments.

DETAILED DESCRIPTION OF THE INVENTION

Figure 1:
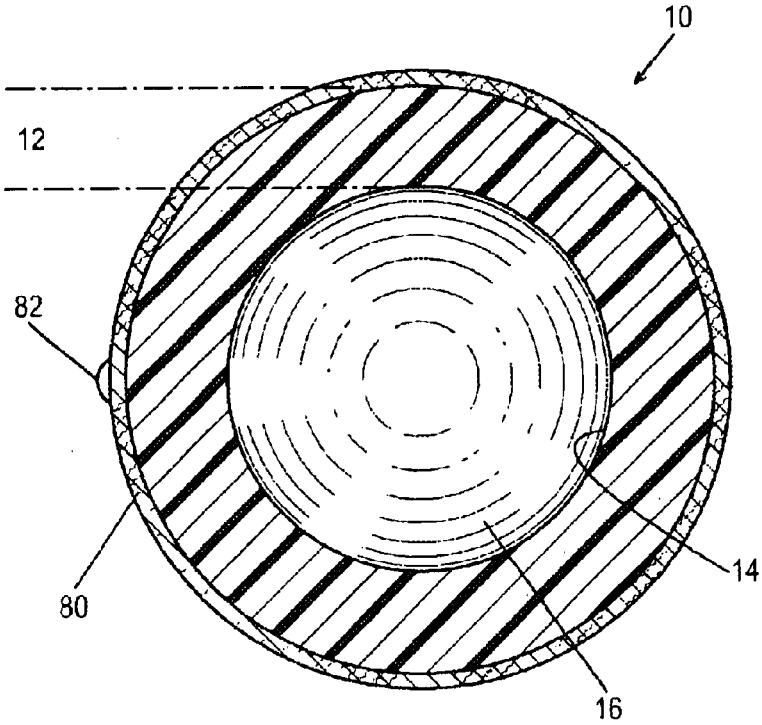
FIG. 1 is a sectional view of a single piece core of an inventive game ball.

For clarity of description and ease of understanding, the invention will be described in connection with softballs, although it will be understood that other game balls can advantageously employ the features of the present invention. Furthermore, it will be understood that like structures and features found in the various figures are identified with the same numbers.

Generally, as shown in FIGS. 1–4, the ball comprises a spherical core. An interior surface of the core defines a central hollow portion that is the central cavity. Preferably, the central cavity is spherical. The core is comprised of a raw core material, which is preferably a cross-linked thermoset elastomeric material of appropriate thickness and sufficient resiliency to withstand repeated striking or contact with a bat during the course of play without "oil canning" or permanent denting. A cover overlies the core.

The thermoset elastomeric material is at least one of the materials selected from the group consisting of natural rubber, such as SMR-CV60 available from Muehistein of Leominster, Mass.; polyisoprene rubber, such as NATSYN 2200 available from Goodyear of Akron, Ohio; acrylic rubber, such as on May 10, 2000, EUROPRENE AR 2503 available from Enichem of Chardon, Ohio; chlorinated polyethylene, such as TYRIN 586 available from DuPont Dow of Wilmington, Del.; chlorosulfonated polyethylene, such as HYPALON 20 available from DuPont Dow of Wilmington, Del.; ethylene acrylic elastomer, such as VAMAC G available from DuPont of Wilmington, Del.; ethylene butene copolymer, such as EXACT 3025 available from Exxon of Baytown, Tex.; ethylene hexene copolymer, such as EXACT 3031 available from Exxon of Baytown, Tex.; ethylene octene copolymer, such as ENGAGE EG 8200 available from DuPont Dow of Wilmington, Del.; ethylene propylene copolymer, such as BUNA EPG 5050 available from Bayer Fibers of Akron, Ohio; ethylene propylene diene terpolymer, such as BUNA EPT 2370 available from Bayer Fibers of Akron, Ohio; nitrile elastomer, such as CHEMIGUM N318B available from Goodyear of Akron, Ohio; polychloroprene, such as NEOPRENE available from DuPont Dow of Wilmington, Del.; styrene butadiene rubber, such as DURADIENE 706 available from Firestone of Akron, Ohio; polyethylene, such as LL-1001 available from Exxon of Baytown, Tex.; ethylene vinyl acetate copolymer, such as EVA LD 706 available from Exxon of Baytown, Tex.; high styrene SBR, such as AMERIPOL 1904 available from Ameripol Synpol of Akron, Ohio; polybutadiene elastomer, such as CARIFLEX BR-1 220 available from Muehlstein of Leominster, Mass.; ethylene carboxylic acid copolymer, such as ESCOR 5401 available from available from Exxon of Baytown, Tex.; and syndiotactic polybutadiene available from JSR America Inc. of Cincinnati, Ohio.

Thermoset elastomeric materials chemically react to cure or solidify or set irreversibly. The reaction is the result of cross-linking of the thermoset material polymer chains induced by heat, irradiation, chemical additives or other known method. Naturally, combinations of the above inducement methods may also be used to cross-link the thermoset material polymer chains.

Additional materials may be included in the raw core material composition. Zinc oxide may be used as a nucleating agent. Antioxidants may be used to protect the polymer from degradation. Examples of suitable antioxidants are AGERITE SUPERLITE and VANOX 1290 available from R.T. Vanderbilt of Norwalk, Conn. Blowing agents that decompose upon application of heat to produce a gas such as air, nitrogen or carbon dioxide in the melted raw core material may be used to form closed or open cell structure. Suitable blowing agents are CELOGEN TSH and CELOGEN OT, available from Uniroyal Chemical of Middlebury, Conn. Zinc stearate may be used as an activator to lower the decomposition temperature of the blowing agent. Zinc stearate is available from Ferro Corporation of Walton Hills, Ohio. Peroxide crosslinking agents decompose at various predetermined temperatures to form free radicals. The free radicals initiate crosslinks between the thermoset material polymer chains to result in a crosslinked thermoset polymer. Suitable peroxide crosslinking agents are DICUP 40C available from Hercules Incorporated of Wilmington, Del. and 230 XL available from R. T. Vanderbilt of Norwalk, Conn. Fillers are used to modify weight and density and reduce cost. Examples of suitable filler materials are #79 hardwood flour available from Composition Materials of Fairfield, Conn. and ground limestone available from Lee Lime of Lee, Mass.

As shown in FIG. 1, the ball 10 may be comprised of a single piece core 12. An interior surface 14 of the core 12 defines a central hollow portion that is the central cavity 16. A cover 80 overlies the core 12. The core 12 for a softball made according to the present invention has a wall thickness in the range of about 10–36 mm. Preferably, the wall thickness should be within the range of about 14–25 mm and most preferably 17–21 mm. The core has a durometer hardness on the Shore C scale (ASTM test method 2240) within the range of about 40–70, with 50–60 being preferred and 52–58 being most preferred.

The relative hardness of the core 12 can be adjusted by altering the composition of the material. For example, a harder elastomeric material can be blended with a softer elastomeric material to arrive at a desired final hardness. Also, a filler such as silica can be used to increase or decrease the desired hardness of a chosen polymer.

Figure 2:
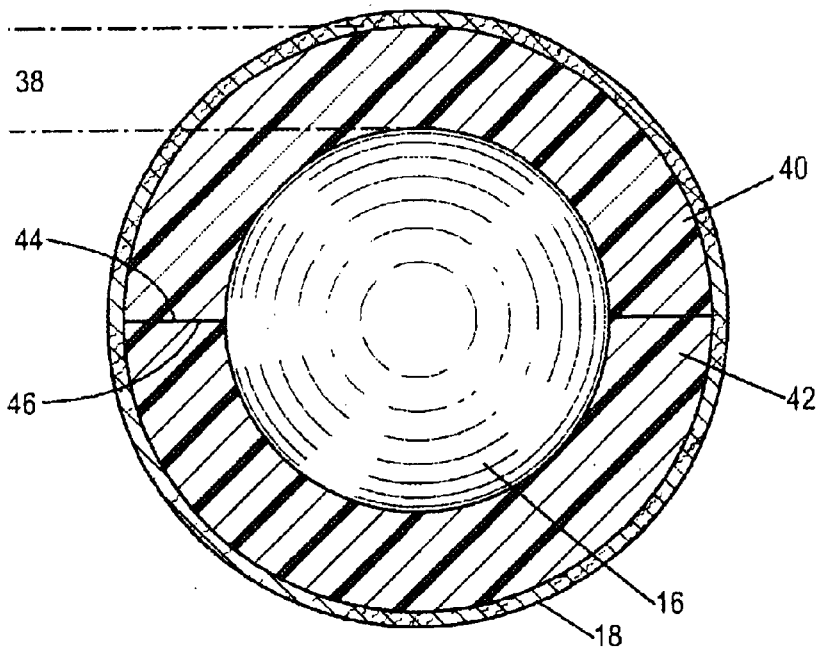
FIG. 2 is a sectional view of a multi-layer core embodiment of the inventive game ball.

Alternatively and less desirably, a single layer core 38 can be manufactured from two hollow hemispheres 40, 42 as shown in FIG. 2. The hemispheres 40, 42 are joined at their respective circumferential edges 44, 46 and glued or welded together to form the hollow spherical core 38.

Figure 3:
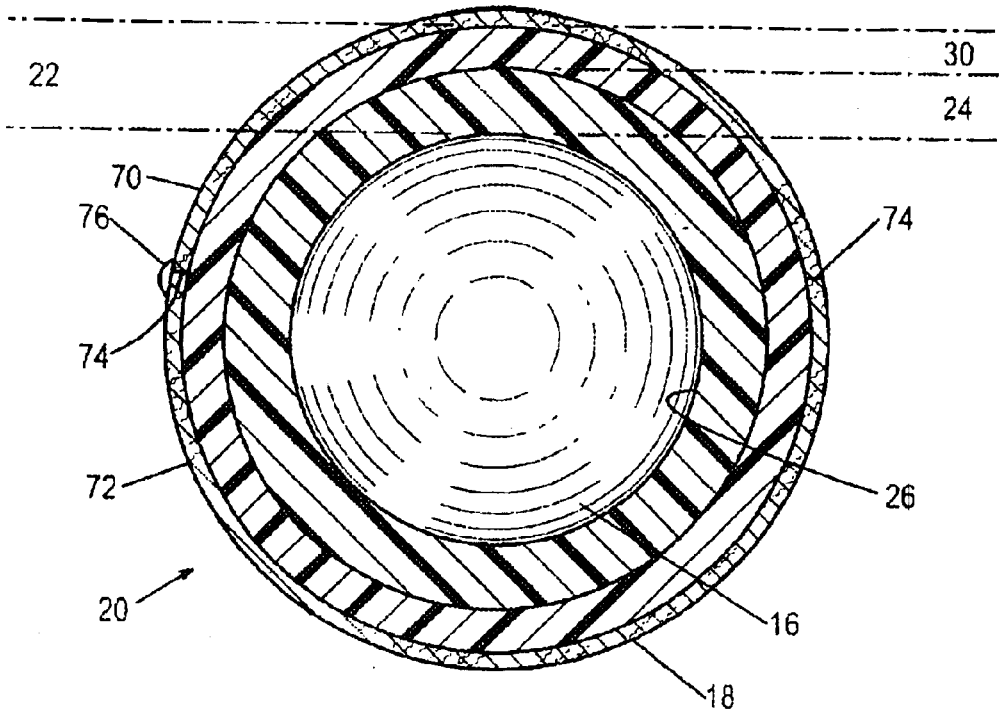
FIG. 3 is a sectional view of a multi-piece single layer core embodiment of the inventive game ball.

FIG. 3 shows a ball 20 having a multi-layer core 22. The multi-layer core 22 comprises an inner layer 24, with the inner surface 26 defining the hollow central cavity 16. An outer layer 30 overlies the inner layer 24. The cover 18 overlies the outer layer 30. It will be appreciated that a multi-layer core may comprise more than two layers.

Figure 4:
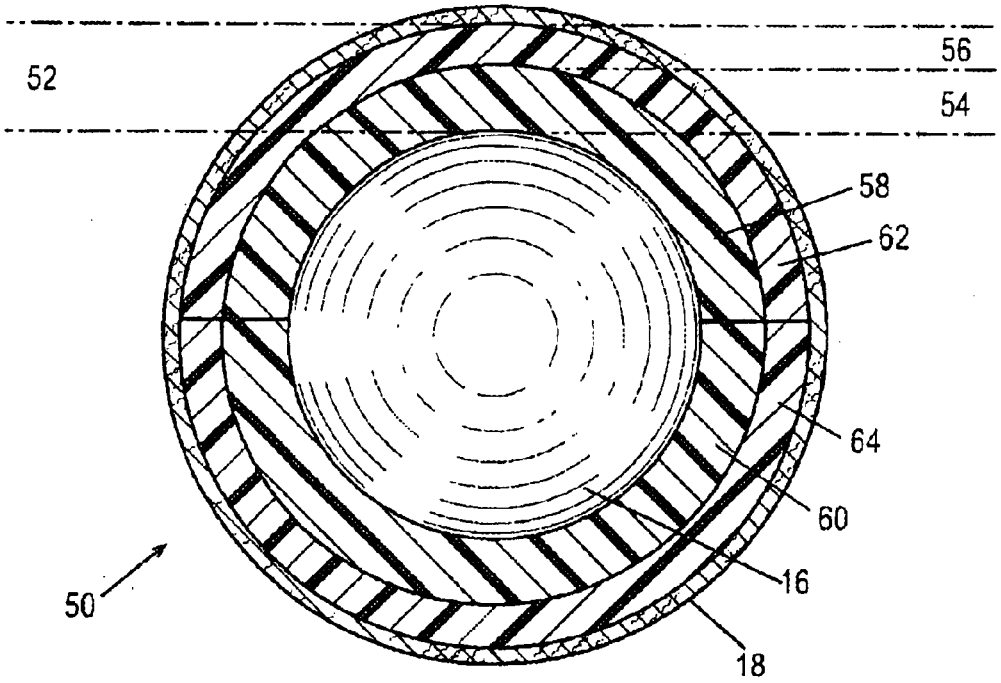
FIG. 4 is a sectional view of a multi-piece multi-layer core embodiment of the inventive game ball.

In the embodiment of the invention shown in FIG. 4, a ball 50 with a multi-layer core 52 having an inner layer 54 and an outer layer 56 is illustrated. A cover 18 overlies the outer layer 56. Each layer 54, 56 is formed from joined pairs of hemispheres 58, 60 and 62, 64 respectively. Alternatively, the inner layer (not shown) may also comprise a single-piece layer similar to core 24 overlaid by outer layer 56.

In the embodiment of FIG. 3, wherein the core comprises multiple layers of material, it is preferred that the core inner layer 24 be relatively harder while the core outer layer 30 is relatively softer. More specifically, in a multi-layer softball core 22, the core inner layer 24 has a Shore C hardness in the range of about 40–70, with 50–60 being preferred and 52–58 most preferred. The core outer layer 30 has a Shore C hardness in the range of about 30–60, with 40–50 being preferred and 42–48 most preferred.

In the above multi-layer core softball, the overall thickness of the core 22 should be within the range of about 10–36 mm. Preferably, the overall core thickness should be within the range of 14–25 mm and most preferably 17–21 mm. The inner layer 24 has a thickness in a range of about 5–18 mm, preferably 7–13 mm and most preferably 9–11 mm. The outer layer 30 has a thickness in a range of about 5–18 mm, preferably 7–1 3 mm, and most preferably 9–11 mm.

Each of the layers 24, 30 comprises the same materials discussed above from which a single layer core 12 is comprised. It should be understood that the material comprising each layer may be different.

In another embodiment of the invention applicable to any of the above-described embodiments, the core may be cellular. In known fashion, a blowing agent is added to the raw core material. The blowing agent decomposes during melting of the raw core material to introduce gas into the melted raw material, thereby forming an open or closed cellular structure in the cured core. Blowing agents such as CELOGEN TSH, CELOGEN 765, CELOGEN OT, CELOGEN AZ and CELOGEN RA, available from Uniroyal Chemical of Middlebury, Conn., are suitable for forming the above cellular structure.

The blowing agent is added to the material from which the core is molded in an amount sufficient to obtain a core material having a desired density. Core density may range from about 0.35 to 0.70 grams per cubic centimeter (gm/cm$^3$). Preferably, the core material density is in the range of 0.40 to 0.60 gm/cm$^3$ and most preferably 0.45 to 0.55 gm/cm$^3$.

It is envisioned that blowing may be used in a multi-layer core having layers of different material densities. For the above-described multi-layer cores 22, 52, the cellular outer layer 30, 56 would have a density in the range of about 0.25–0.50 gm/cm$^3$, preferably 0.25–0.45 gm/cm$^3$, and most preferably 0.25–0.35 gm/cm$^3$ The cellular inner layer 24, 54 would have a density in the range of about 0.30–0.70 gm/cm$^3$, preferably 0.30–0.60 gm/cm$^3$, and most preferably 0.30–0.55 gm/cm$^3$.

The preferred method of manufacturing the single-piece core 12 is by rotational molding. The materials comprising the raw core material are mixed in an internal mixer such as a BANBURY® or a twin screw extruder. The mixing temperature is kept below the decomposition temperature of any added blowing or crosslinking agent.

The resulting mixed raw core material is formed into pieces such as by chopping or pelletizing. The pieces are weighed to the desired final weight of the hollow core, usually from 140 to 150 grams for a softball, and added to a rotational mold. The mold sections are closed, clamped together and rotated around two perpendicular axes. During rotation, heat is applied to the mold. The applied heat softens and melts the raw core material. Rotation of the mold gradually distributes the melted raw core material evenly over the surface of the mold. At a predetermined temperature, the blowing agent (if present) decomposes and introduces gas into the melted material and the crosslinking agent reacts with the thermoset elastomeric polymer to crosslink the polymer chains. The result is a crosslinked, cellular material forming a one-piece core 12. The amount of raw core material and amount and type of blowing agent is adjusted to obtain the desired core thickness and core density.

After a predetermined time, the mold is cooled and the solidified core 12 is removed. The rotationally molded core 12 with a one-piece seamless structure is more durable than cores 38 made up of multiple pieces.

In the embodiment shown in FIG. 3, the one-piece outer layer 30 is seamlessly molded over the one-piece inner layer 24.

Alternatively and less desirably, a single layer core 38 can be manufactured from two hollow hemispheres 40, 42 as shown in FIG. 2. The hemispheres are manufactured by molding the required amount of raw core material under the application of heat and minimum pressure. The molding process forms and crosslinks the raw core material into a hemisphere. The hemispheres 40, 42 are joined at their respective circumferential edges 44, 46 and glued or welded together to form a hollow spherical core 38. When edges 44, 46 are glued with a vulcanizing rubber cement, the core 38 is subject to further treatment with heat to cause the glued edges to become cross-linked, thereby increasing the structural integrity of the finished core 38.

In the embodiment of the invention shown in FIG. 4, a ball 50 with a multi-layer core 52 having an inner layer 54 and an outer layer 56 is formed. Each layer 54, 56 is formed from joined pairs of hemispheres 58, 60 and 62, 64 respectively. The layers 54, 56 are preferably formed in intimate full surface contact with one another. Each hemisphere is molded and joined together, such as with an adhesive, to improve the integrity of the hemisphere and resist separation of the layers. Hemispheres 58 and 60 may be replaced with a single-piece similar to core 12. It is also envisioned that the multi-layered hemispheres 58, 62 and 60, 64 may be formed in a single operation. Each multi-layered hemisphere is formed by layering uncured sheets of the raw core material in a mold and subjecting the layers to conditions for curing. As in the case of a single-layer core, the multi-layered hemispheres are glued or welded together at their respective circumferential edges, and then if appropriate to the adhesive, exposed to conditions for promoting cross-linking of the glue. Naturally, the circumferential edges of each layer could be offset to add strength to the resulting game ball.

A cover 18 encloses the core. As shown in FIG. 3, the cover may be a traditional sewn type having multiple panels of leather, synthetic leather or polymer. The panel material typically used to cover a softball has a thickness in the range of 1–2 mm. The core of the gameball will be molded to a size appropriate for accommodating the thickness of the panel material used in covering the ball, while ensuring the finished game ball size falls within the appropriate size ranges to meet league, regulation or other desired standards. A traditional sewn-on cover for a softball is formed in two separate panels 70, 72, each being "dog bone" shaped to interfit when wrapped around the spherical core of the ball. A seam 74 is located between the panels of the cover and follows the "dog bone" shape of the panels. Typically, the seam on a softball is sewn together with thread in the distinctive and well-known herringbone stitch pattern 76. The sewn-on cover is tightly fitted and in intimate full-surface contact with the core of the ball.

Alternatively, as shown in FIG. 1, the ball may include a cover 80 which is molded in place or otherwise applied, for example, by coating the core with a polymeric substance which cures in place. The molded cover 80 may include simulated stitching, panel lines and other detail 82 to simulate the appearance of a sewn-on cover. Materials from which a molded cover 80 is formed include polyvinyl chloride, butyl rubber and polyurethane. Other proprietary formulations are available for a molded cover. These proprietary formulations include, for example, white natural or synthetic rubber formulations available from Colonial Rubber Works, Inc. of Kingstree, S.C.

While not shown, the outer surface of the core 12, 38 or outer core layer 30, 56 may comprise the cover in some embodiments of the invention. When a ball according to the present invention is made with a molded polymeric cover 80 or when the core outer surface comprises the ball cover, white pigment may be added to the core 12, 38 or outermost core layer 30, 56 in order to simulate the white cover of a traditional leather-covered softball. Alternatively, the white color of a traditional ball may be painted onto the surface of the molded ball. In addition, the stitching molded into the cover of the ball may be picked out with red or other appropriately colored paint to further simulate the appearance of a traditionally constructed baseball or softball.

The coefficient of restitution is important in determining the "liveliness" of the ball. The coefficient of restitution is measured by propelling a ball against a hard surface at an initial speed of 88 feet per second and measuring the rebound speed of the ball. The coefficient of restitution is expressed in terms of the ratio of the rebound speed to the initial speed. The coefficient of restitution of an inventive gameball in any embodiment is within the range of 0.400–0.600, with 0.440–0.500 being preferred, and nominally about 0.470 being most preferred.

The following examples are provided for purposes of illustration and are not intended to limit the invention herein. Table 1 lists the compositions of prepared hollow game ball cores Examples 1–8.

The materials of Example 1 were mixed in a BANBURY® internal mixer to create a raw core material that was chopped into pieces. The Zn stearate functions as an activator and also to improve material flow. The CELOGEN OT functions as a blowing agent. The ZnO functions as a nucleating agent to improve blowing.

147 grams of the chopped raw core material was placed in a rotational mold. The mold was closed and rotated in an oven heated to 260° C. for 13 minutes. After removal and cooling, the resulting core weighed 146 grams, was soft with good rebound characteristics and had a coefficient of restitution of 0.573. The molded core was sectioned in half to reveal a wall thickness of about 19 mm and a hollow, spherical interior cavity. The molded core had a semi-rigid cellular structure.

Examples 2–8 were prepared in a similar manner to Example 1. Table 2 is a comparison of the properties of hollow core Examples 2–8 obtained in Table 1 versus a standard solid cellular polyurethane core. As can be seen from the results in Table 2, a hollow softball core can be manufactured which has properties similar to, or intentionally displaced from, a solid, cellular polyurethane core. Naturally, the hollow cores present manufacturing advantages when compared to traditionally constructed solid center softball cores. In any embodiment, the inventive hollow game ball exhibits desirable properties of higher moment of inertia, lower spin rate and lesser influence due to Magnus effect. Additionally, the inventive game ball resists denting during play so that these desirable properties are retained during use. Further, the construction of the inventive game ball allows the desirable properties to be incorporated into the game ball at a lesser cost than for traditional game balls. As will be apparent to persons skilled in the art, various modifications and adaptations of the structure above described will become readily apparent without departure from the spirit and scope of the invention.

TABLE 1

Hollow Softball Core Formulations (all parts by weight)

| | Example 1 | Example 2 | Example 3 | Example 4 | Example 5 | Example 6 | Example 7 | Example 8 |
|---|---|---|---|---|---|---|---|---|
| Escor 5401[1] | — | 100 | — | 60 | 70 | 70 | 100 | 60 |
| Exact 3025[1] | — | — | 100 | — | — | — | — | — |
| Eva LD 706[1] | 100 | — | — | 40 | 20 | 30 | — | — |
| Cariflex BR-1220[2] | — | — | — | — | 10 | — | — | — |
| LL-1001 PE[1] | — | — | — | — | — | — | — | 40 |
| Zinc Stearate | 2 | 2 | — | 2 | 2 | 2 | 2 | 1 |
| Di Cup 40C Peroxide[3] | 4 | 3 | — | — | — | — | 3 | 1.5 |
| 230 XL Peroxide[4] | — | — | 4 | 4 | 4 | 4 | — | — |
| Celogen OT[5] | 2 | 2 | 3 | 3 | 3 | 3 | 2 | — |
| Celogen 765[5] | — | — | — | — | — | — | — | 2 |
| Zinc Oxide | 4 | 4 | 4 | 4 | 4 | 4 | 4 | 5 |
| Vanox 1290[4] | — | — | 1 | 1 | 1 | 1 | — | — |
| Limestone | — | — | — | 20 | 20 | — | — | — |
| #79 Hardwood Flour[6] | — | — | — | — | — | — | 50 | — |
| TOTAL | 112 | 111 | 112 | 134 | 134 | 114 | 161 | 109.5 |

[1]available from Exxon of Baytown, TX.
[2]available from Muehlstein of Leominster, MA.
[3]available from Hercules Inc. of Wilmington, DE.
[4]available from R.T. Vanderbilt of Norwalk, CT.
[5]available from Uniroyal Chemical of Middlebury, CT.
[6]available from Composition Materials of Fairfield, CT

TABLE 2

Properties Of Hollow Softball Cores Of Table 1 Vs. Solid, Cellular Polyurethane Core

| | Example 2 | Example 3 | Example 4 | Example 5 | Example 6 | Example 7 | Example 8 |
|---|---|---|---|---|---|---|---|
| Rebound | Lower | Lower | Same | Higher | Higher | Same | Lower |
| Hardness | Slightly Harder | Softer | Same | Slightly Softer | Harder | Slightly Harder | Slightly Harder |

What is claimed is:

1. A hollow game ball comprising:

a substantially spherical core defining a substantially spherical internal cavity, said core comprised of a cross-linked thermoset elastomeric material having a Shore C hardness within the range of 40 to 70; and a cover overlying said core.

2. The game ball of claim 1, wherein said core comprises inner and outer surfaces defining a substantially uniform wall thickness therebetween, said wall thickness in the range of 10 to 36 millimeters.

3. The game ball of claim 1, wherein said game ball is a softball having a circumference in the range of 11 to 12 inches and a coefficient of restitution in the range of 0.40 to 0.60.

4. The game ball of claim 1, wherein said core material is cellular with a density in the range of 0.25 to 0.70 grams per cubic centimeter.

5. The game ball of claim 1, wherein said thermoset elastomeric material is comprised of one or more materials selected from the group consisting of ethylene carboxylic acid copolymers, ethylene butene copolymers, ethylene vinyl acetate copolymers, cis-polybutadiene elastomers, high styrene butadiene elastomers and syndiotactic polybutadiene elastomers.

6. The game ball of claim 1, wherein said core is comprised of multiple layers.

7. The game ball of claim 1, wherein said core is comprised of an inner layer having a hardness and an outer layer having a hardness less than said inner layer hardness.

8. The game ball of claim 1, wherein said core is comprised of an inner layer and an outer layer, said inner layer having a Shore C hardness in the range of 40 to 70 and said outer layer having a Shore C hardness in the range of 30 to 60.

9. The game ball of claim 1, wherein said core is comprised of an inner layer and an outer layer, said inner layer having a thickness in the range of 5 to 18 millimeters and said outer layer having a thickness in the range of 5 to 18 millimeters.

10. The game ball of claim 1, wherein said game ball comprises a baseball or softball.

11. The game ball of claim claim 1, wherein said core is comprised of an inner layer and an outer layer, said outer layer is comprised of at least one material selected from the group consisting of ethylene vinyl acetate, polybutadiene polymers and ethylene butene copolymers and said inner layer is comprised of at least one material selected from the group consisting of ethylene carboxylic acid copolymer, ethylene butene copolymer elastomers and syndiotactic polybutadiene.

12. The game ball of claim 1, wherein said core is comprised of an inner layer and an outer layer, at least one of said layers being cellular.

13. The game ball of claim 1, wherein said core is comprised of an inner layer and an outer layer, said outer layer is cellular with a density ranging from 0.30 to 0.70 grams per cubic centimeter and said inner layer is cellular with a density ranging from 0.25 to 0.50 grams per cubic centimeter.

14. The game ball of claim 1, wherein said cover is comprised of a plurality of panels stitched together.

15. The game ball of claim 1, wherein said cover is molded as a seamless piece over said core, said cover having molded indicia.

* * * * *